US005341653A

United States Patent [19]

Tippmann et al.

[11] Patent Number: 5,341,653

[45] Date of Patent: Aug. 30, 1994

[54] APPARATUS AND METHOD FOR DISPOSING OF CONDENSATE FROM EVAPORATOR DRIP PANS

[76] Inventors: Joseph R. Tippmann, HRC-33, Box 8419, Rapid City, S. Dak. 57701; Vincent P. Tippmann, 8605 N. River Rd., New Haven, Ind. 46774

[21] Appl. No.: 145,086

[22] Filed: Nov. 3, 1993

[51] Int. Cl.[5] ..... F25D 21/14

[52] U.S. Cl. ..... 62/288; 62/280

[58] Field of Search ..... 62/272, 275, 280, 285, 62/288, 289, 291

[56] References Cited

U.S. PATENT DOCUMENTS

| | | | |
|---|---|---|---|
| 2,335,553 | 11/1943 | Valverde | 62/291 |
| 3,224,216 | 12/1965 | Crouch | 62/285 |
| 3,383,878 | 5/1968 | Booth | 62/272 |
| 4,748,821 | 6/1988 | Berenter | 62/188 |
| 4,843,835 | 7/1989 | Goetz et al. | 62/285 |
| 4,882,911 | 11/1989 | Immel | 62/288 |

*Primary Examiner*—Henry A. Bennet
*Assistant Examiner*—William C. Doerrler
*Attorney, Agent, or Firm*—Joseph J. Baker

[57] ABSTRACT

An apparatus and method for disposing of the condensate collected in the drip pan of the evaporator coil of a refrigeration system located within a storage enclosure. An air pump is used to withdraw the condensate by aspiration from the drip pan and deposit it in a storage container outside of the enclosure. The stored condensate is subsequently transferred to a pan open to the atmosphere from which the condensate evaporates.

15 Claims, 4 Drawing Sheets

FIG. 3
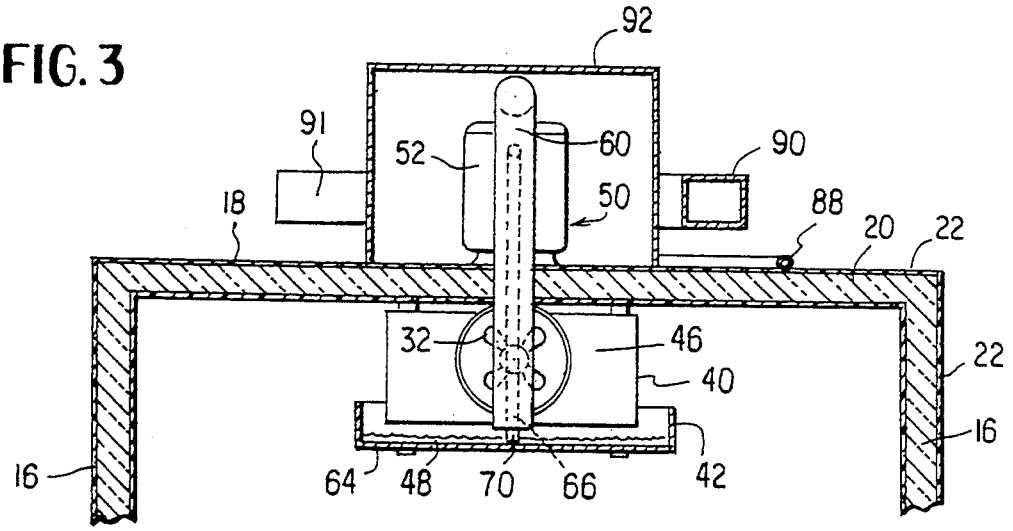
FIG 4
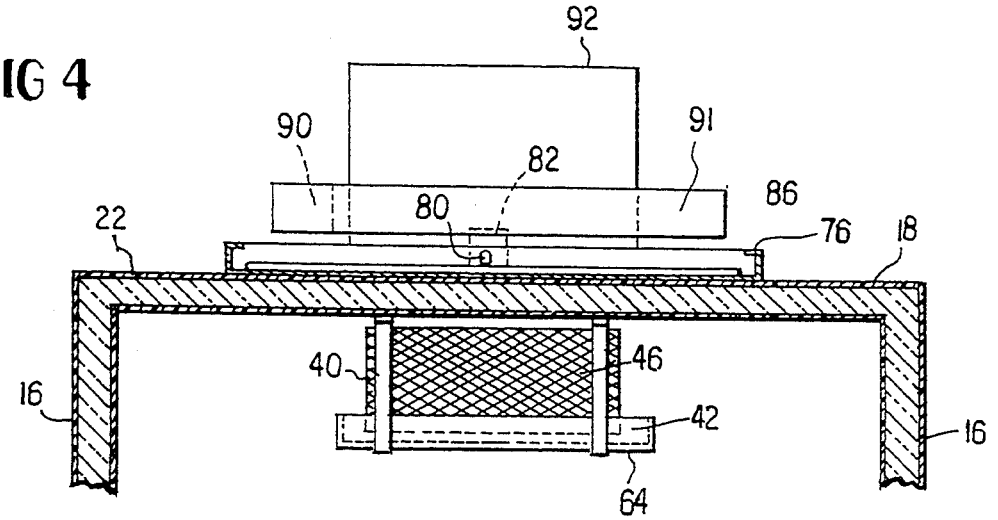
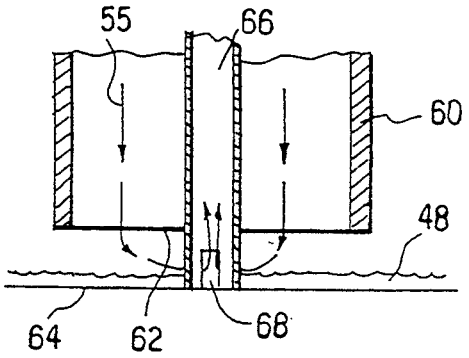
FIG.5

APPARATUS AND METHOD FOR DISPOSING OF CONDENSATE FROM EVAPORATOR DRIP PANS

BACKGROUND OF THE INVENTION

This invention relates to an apparatus and method for disposing of evaporator condensate and more specifically to an air pump for aspirating the condensate from the drip pan of the evaporator coil in a refrigerated storage enclosure and depositing it for evaporation to the roof of the enclosure.

Applicant is unaware of the use of an air pump to withdraw condensate from the drip pan of an evaporator's coil located adjacent the ceiling of a refrigerated storage enclosure of the type, for example, set forth in my U.S. Pat. No. 4,925,509 or a building. Generally, in the prior art, the condensate is piped to a drain or other area and permitted to flow there by gravity or be pumped. This prior art method is satisfactory if there is a drain or other area for disposal proximate to the enclosure and if the enclosure is located in a climate which does not experience freezing temperatures. However, if the enclosure is portable it is often placed in areas where there is no drain to dispose of the condensate, for example, inside a building or on a large paved surface such as a parking lot. If the enclosure is a separate building or room in a building, it may be desirable to transfer the condensate to the outside surface of the roof of the building from which it can evaporate rather than pipe it to a drain. If the drain is at a location remote from the enclosure, extensive piping and large pumps may be needed. Such piping may also require extensive insulation and the expense of electrically heating the pipe to prevent freezing.

The present invention solves the problems posed by condensate disposal methods of the prior art by utilizing an air pump located on the top of the enclosure which has concentric pipes extending into the drip pan of the evaporator coil The condensate is entrained in a rapid flow of air between the pipes and brought back to a storage container. When the air flow shuts off, the stored condensate is permitted to drain into a large open pan from which it can evaporate into the atmosphere.

It is therefore the primary object of the present invention to provide a superior apparatus and method of collecting and disposing of evaporator coil condensate.

It is another object of the present invention to provide a totally self-contained disposal apparatus enabling the storage enclosure to be located anywhere including climates where freezing temperatures are experienced.

It is a still further object of the invention to provide a method of removing the liquid condensate from an evaporator drip pan wherein the apparatus has no moving parts in contact with the condensate that can freeze and thus cause a malfunction.

It is yet another object of the present invention to provide a disposal apparatus of the subject type which can be relatively easily and inexpensively installed in both new and existing refrigerated storage enclosures.

These and other objects and purposes of this invention will be understood by those acquainted with the design and construction of refrigerated storage enclosures and air pumps upon reading the following specification and the accompanying drawings.

BRIEF DESCRIPTION OF THE DRAWINGS

FIG. 3 is a cross-sectional view taken along the lines 3—3 of FIG. 1;

FIG. 4 is a cross-sectional view taken along the lines 4—4 of FIG. 1;

FIG. 5 is an enlarged cross-sectional view of the end of the aspiration pipe of the present invention.

DETAILED DESCRIPTION OF PREFERRED EMBODIMENTS

Figure 1:
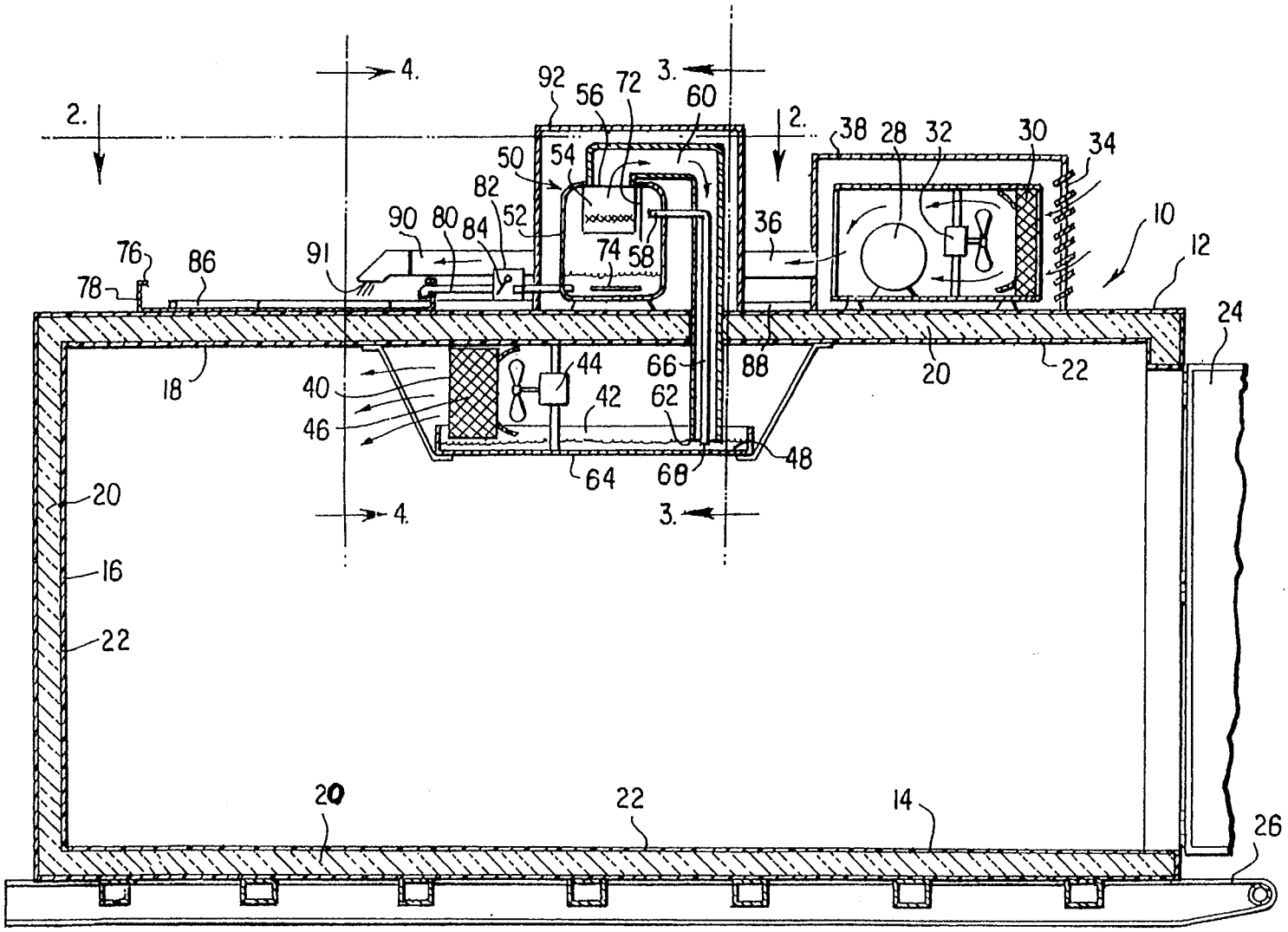
FIG. 1 is a side elevational view in part cross-section and with parts broken away of a refrigerated storage enclosure employing the present invention.

Referring now to the drawings where like characters of reference indicate like elements in each of the several figures. FIG. 1 shows generally at 10 a portable refrigerated storage enclosure employing the apparatus and method of the present invention for disposing of condensate from the drip pan of an evaporator coil. The storage enclosure has an outer shell 12, a floor 14, vertical upstanding side walls 16 and a roof 18, all consisting of, for example, a polyurethane core 20 covered on both sides with a layer of fiberglass reinforced resin 22 and forming a monolithic structure having a door 24. The enclosure 10 is typically secured to a skid 26 which facilitates its portability. It being understood, of course, that the refrigerated enclosure can be a permanent building structure where the walls of the enclosure are insulated by, for example, cork or the like.

The storage enclosure 10 is cooled by a conventional refrigeration system comprising a compressor 28 and condenser coil 30 employing a fan 32 for drawing outside air through the louvered opening 34 and coil 30 and out a duct 36 formed in the hood 38, all of which are located on the roof 18. The compressor 28 and condensing coil 30 are operatively connected by piping (not shown) to an evaporator coil 40 suspended from the underside of the roof 18 inside of the enclosure 10. The evaporator 40 is positioned above a drip pan 42. A fan 44 circulates air from the inside of the enclosure around and through the coil 46 of the evaporator 40. As moisture from the air collects on the coils 46, it drops and is collected as condensate 48 in drip pan 42 in a well-known manner. This condensate must be periodically removed or it will overflow the drip pan.

The apparatus of the present invention for removing this accumulated condensate 48 can best be seen in FIGS. 1 and 3. The apparatus comprises an air pump 50 similar to the well-known wet/dry vacuum devices. These devices typically have a canister-type enclosure 52 with a high cubic foot per minute (cfm) motor and fan unit 54 for providing a large volume of air 55 at an outlet 56. Air is drawn into the canister 52 from an inlet 58. The outlet 56 is connected to a cylindrical-shaped pipe 60 which extends through the roof 18 to a position inside of the drip pan 42. The end 62 of the pipe 60 is a distance above the floor 64 of the drip pan to prevent clogging of the end in the event the condensate 48 freezes. The inlet 58 is connected to a pipe 66 which extends into the pipe 60 and is concentric therewith to a point within the drip pan 42 wherein the end 68 of the pipe 66 rests against the floor 64 of the drip pan, as can best be seen by referring to FIG. 5. The end 68 has a recess 70 formed on opposite sides thereof which extends a distance vertically above the floor 64 of the drip pan. Electrical energization of the motor and fan unit 54 causes air to be drawn into pipe 66 through recesses 70 through inlet 58 of the canister 52 and through outlet 56 to the end 62 of pipe 60. Any condensate 48 on the floor 64 of the drip pan 42 will be entrained in the rush of air exiting the end 62 of pipe 60 and entering the recess 70 and will thereby be drawn or lifted up pipe 66. The air and entrained water entering inlet 58 will initially engage a deflector plate 72 located within the canister 52. The deflector plate 72 will cause the water in the air to be separated therefrom and drop to the bottom of the canister 52 where it is stored until removal. This evacuation process continues until substantially all of the condensate 48 in the drip pan 42 is deposited in the canister 52. Thus, as can be seen, the condensate 48 is withdrawn from the drip pan 42 without ever having come in contact with any moving parts such as, for example, the conventional impeller of a pump thus greatly reducing the likelihood of a malfunction due to freezing or clogging by debris. The condensate 48 can be kept from freezing by means of an electric heating element 74 in the bottom of the canister 52 if necessary.

Figure 2:
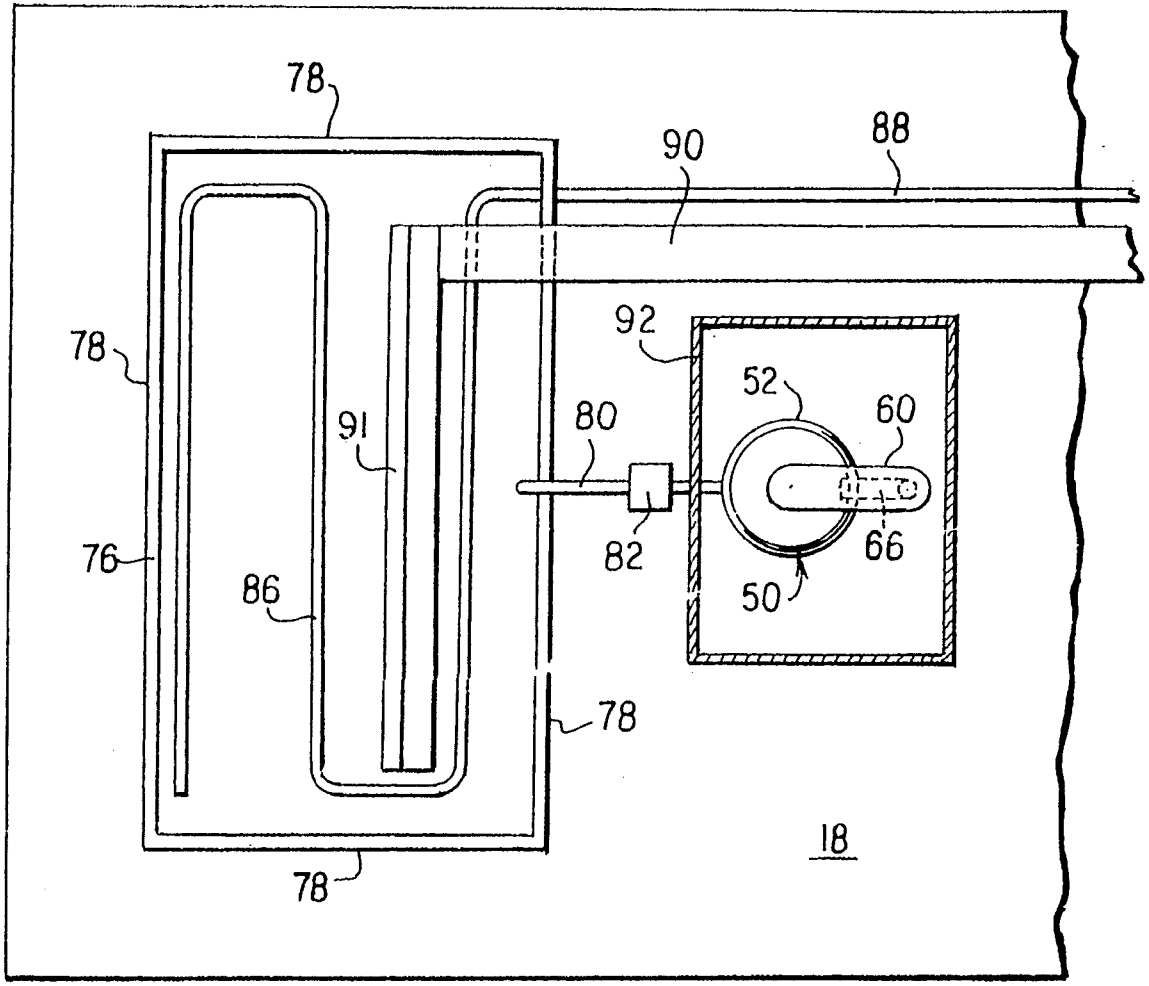
FIG. 2 is a plan view taken along the lines 2—2 of FIG. 1.

In one embodiment, to dispose of the stored condensate 48, a large pan 76 is provided on the roof 18, as shown in FIGS. 2 and 4. The pan is open to the atmosphere and can be formed of fiberglass material 22 the same as roof 18 either with sidewalls 78, as shown, or recessed into the core 20 forming the roof member 18. The condensate 48 is caused to drain into the pan 76 via pipe 80 through a one-way check valve 82 having for example a flapper-type valve head 84. During operation of the motor/fan unit 54, the suction or vacuum created within the canister 52 will keep the flapper 84 of the check valve 82 closed, thus no condensate 48 can flow into the pan 76. However, when the motor/fan unit 54 is de-energized, the suction dissipates and the force of the water against the flapper 84 will move it to the open position to permit the condensate 48 stored in the canister to drain through pipe 80 into the pan 76 from which it can evaporate into the atmosphere. The motor/fan unit 54 can be energized in conjunction with the defrost cycle of the refrigeration system or it can be energized periodically by a separate timer (not shown). In order to keep the condensate 48 in the pan 76 from freezing before it can evaporate, a coil 86 can be operatively connected by piping 88 to the condenser coil 30 to transfer heat in the refrigerant flowing in the condenser coil 30 to the coil 86. In addition, if added air flow over the pan 76 is felt to be needed to aid in evaporation of the condensate 48, a large duct 90 can be connected to the opening 34 in hood 38 to transfer air heated by the condenser coil 30 to the surface of the condensate 48 via outlet 91. The concentricity of the pipes 60, 66 enables the air warmed by the motor/fan unit 54 to warm the pipe 66 and prevent freezing of the entrained condensate 48. A hood 92 is also provided to enclose the canister 52 and associated piping and check valve.

Figure 6:
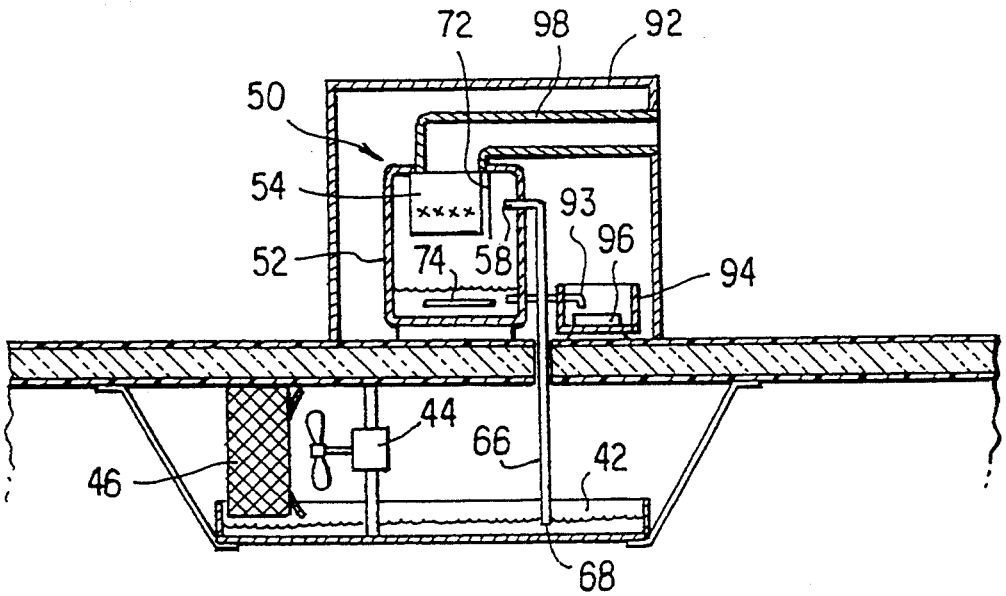
FIG. 6 is a cross-sectional view of another embodiment of the condensate evaporating apparatus.

In another embodiment, shown in FIG. 6 the stored condensate 48 is transferred by pipe 93 to a boil-out pan 94 having an electrical heating element 96 in the bottom thereof to ensure dissipation of the condensate 48 when energized. Further, the pipe 60 in the first embodiment, which was concentric with pipe 66, has been replaced by pipe 98 which is vented to the atmosphere. This venting of the air entrained with the condensate 48 rather than returning it to the inside of the enclosure 10 is accomplished by allowing the air pump 50 to run only a short period of time so that cold air in the enclosure is not withdrawn in any large quantity. A timer (not shown) turns the air pump 50 on at the expiration of the timed defrost cycle and turns it off at the thermostatic termination thereof when the fans are energized. If the enclosure is not of the portable-type but is a permanent building structure with a flat roof, the large pan 76 can be eliminated entirely and the stored condensate merely permitted to drain onto the outside surface of the roof from which it can evaporate into the atmosphere. The roof surface, which is usually a built-up combination of water impermeable sheet material covered with tar or the like, covering the building roof structural members would serve as a means open to the atmosphere and replace the pan 76 necessary for the portable enclosure. This would be similar to the embodiment suggested previously wherein the pan is formed by recessing a portion of the surface of roof member 18 itself of the portable enclosure 10.

Applicant has thus described his novel method and apparatus for withdrawing condensate from the evaporator drip pan in a refrigerated storage enclosure and depositing it into a pan outside of the enclosure wherefrom it can evaporate into the atmosphere.

What is claimed is:

1. In a refrigerated storage enclosure of the type having a plurality of insulated upstanding side wall members at least one of which has a doorway therethrough, a floor member beneath said side wall members and a roof member over said side wall members, a refrigeration compressor and condenser mounted on the outside of said enclosure operatively connected to an evaporator coil mounted on the inside of said enclosure for cooling the inside of said enclosure, and drip pan means beneath said evaporator coil for collecting condensation dropping from said coil, said improvement comprising:

a) open means adjacent said outside of said enclosure for receiving said collected condensation, b) air pump means mounted on said outside of said roof for withdrawing said collected condensate from said drip pan, c) means for storing said withdrawn condensate, and d) means for transferring said stored condensate to said open means adjacent the outside of said roof for evaporation into the atmosphere.

2. In a refrigerated enclosure as set forth in claim 1 wherein said air pump has an outlet pipe which extends through said roof for delivering pressurized air to a point above said condensate in said drip pan and an inlet pipe which extends through said roof for providing a source of suction proximate said pressurized air outlet pipe whereby as said pressurized air exiting said outlet pipe is drawn into said inlet proximate thereto, said condensate in said drip pan is entrained in said air and deposited in said storage container.

3. In a refrigerated enclosure as set forth in claim 1 wherein said transfer means has valve means which opens when said air pump means stops running to thereby permit condensate in said storage means to drain into said open means adjacent said roof.

4. In a refrigerated enclosure as set forth in claim 1 wherein said open means adjacent said enclosure is a pan means and said pan means has heater means therein operatively connected to said condensing coil to facilitate the evaporation of said condensate transferred thereto.

5. In a refrigerated enclosure as set forth in claim 1 wherein said storage means has heater means to keep said stored condensate from freezing.

6. In a refrigerated enclosure as set forth in claim 1 wherein said inlet pipe has at least one aperture formed in the side thereof adjacent the bottom of said drip pan to control the amount of pressurized air and condensate entering said inlet pipe.

7. In a refrigerated enclosure set forth in claim 1 wherein said air pump has an outlet pipe vented to the atmosphere and an inlet pipe which extends through said roof into said condensate for providing a source of suction whereby said condensate in said drip pan is entrained in air from the interior of said enclosure and deposited in said storage container.

8. In a refrigerated enclosure as set forth in claim 7 wherein said improvement further comprises: a boil-out pan means having electrical heater means in the bottom thereof and drain means for transferring said condensate in said storage container into said boil-out pan means whereby said heater means causes evaporation of said condensate into the atmosphere.

9. A method for disposing of condensate from the drip pan of an evaporator coil of the refrigeration system of a refrigerated storage enclosure comprising the steps of:

a) providing an air pump means for withdrawing said collected condensate from said drip pan,
b) providing container means for storing said withdrawn condensate,
c) providing open means exposed to the atmosphere for receiving said stored condensate, and
d) providing means for transferring said stored condensate to said open means for evaporation into said atmosphere.

10. The method as set forth in claim 9 wherein said air pump has an outlet pipe for delivering pressurized air to a point above said condensate in said drip pan and an inlet pipe for providing a source of suction proximate said pressurized air outlet whereby said pressurized air exiting said outlet pipe is drawn into said inlet proximate thereto, said condensate in said drip pan is entrained in said air and deposited in said storage container.

11. The method as set forth in claim 9 wherein said transfer means has valve means which opens when said air pump means stops running to thereby permit condensate in said storage means to drain into said open means.

12. The method as set forth in claim 11 wherein said inlet pipe has at least one aperture formed in the side thereof adjacent the bottom of said drip pan to control the amount of pressurized air and condensate entering said inlet pipe.

13. The method as set forth in claim 12 wherein said open means has heater means therein operatively connected to said refrigeration system to facilitate the evaporation of said condensate transferred thereto.

14. The method as set forth in claim 9 wherein said air pump has an outlet pipe vented to the atmosphere and an inlet pipe which extends into said condensate in said drip pan for providing a source of suction whereby said condensate in said drip pan is entrained in air from the interior of said enclosure and deposited in said storage container.

15. The method as set forth in claim 14 wherein said improvement further comprises: a boil-out pan means having electrical heater means in the bottom thereof and drain means for transferring said condensate in said storage container into said boil-out pan means whereby said heater means causes evaporation of said condensate into the atmosphere.

* * * * *